US006796234B1

(12) United States Patent
Busshoff

(10) Patent No.: US 6,796,234 B1
(45) Date of Patent: Sep. 28, 2004

(54) HOLDING DEVICE FOR FLEXOGRAPHIC PRINTING SLEEVES

(75) Inventor: Helmut Busshoff, Ahaus (DE)

(73) Assignee: Rotec-Hulsensysteme GmbH & Co. KG, Ahaus (DE)

( * ) Notice: Subject to any disclaimer, the term of this patent is extended or adjusted under 35 U.S.C. 154(b) by 0 days.

(21) Appl. No.: 09/763,484

(22) PCT Filed: Aug. 17, 1999

(86) PCT No.: PCT/DE99/02613

§ 371 (c)(1),
(2), (4) Date: Oct. 11, 2001

(87) PCT Pub. No.: WO00/10809

PCT Pub. Date: Mar. 2, 2000

(30) Foreign Application Priority Data

Aug. 21, 1998 (DE) ..... 198 37 995
Nov. 3, 1998 (DE) ..... 198 50 623

(51) Int. Cl.[7] ..... B41F 27/00
(52) U.S. Cl. ..... 101/389.1; 101/382.1
(58) Field of Search ..... 101/365, 382.1, 101/383, 389.1, 368

(56) References Cited

U.S. PATENT DOCUMENTS

| | | | | | |
|---|---|---|---|---|---|
| 2,250,025 | A | * | 7/1941 | Klein | 242/559.4 |
| 2,986,997 | A | | 6/1961 | Schmutz | 101/248 |
| 3,166,013 | A | * | 1/1965 | Wyllie et al. | 101/378 |
| 3,782,234 | A | * | 1/1974 | Rodach | 83/665 |
| 4,030,415 | A | * | 6/1977 | Fellows | 101/382.1 |
| 4,144,813 | A | * | 3/1979 | Julian | 101/382.1 |
| 4,150,622 | A | * | 4/1979 | Stollenwerk et al. | 101/378 |
| 4,624,184 | A | * | 11/1986 | Katz et al. | 101/375 |
| 4,651,642 | A | * | 3/1987 | Gravelle | 101/269 |
| 4,656,942 | A | * | 4/1987 | Vertegaal et al. | 101/493 |
| 4,685,393 | A | * | 8/1987 | Saueressig | 101/375 |
| 4,794,858 | A | * | 1/1989 | Katz | 101/375 |
| 4,831,709 | A | * | 5/1989 | Yoshimura | 29/426.4 |
| 4,903,597 | A | * | 2/1990 | Hoage et al. | 101/401.1 |
| 5,025,998 | A | * | 6/1991 | Hutzenlaub et al. | 242/559.1 |
| 5,036,766 | A | | 8/1991 | Songer | 101/375 |
| 5,472,153 | A | * | 12/1995 | Crowley et al. | 242/420.3 |
| 5,507,228 | A | * | 4/1996 | Schulz | 101/375 |
| 5,601,020 | A | * | 2/1997 | Dawley et al. | 101/217 |
| 5,813,343 | A | * | 9/1998 | Harb | 101/407.1 |
| 5,904,095 | A | * | 5/1999 | Nelson | 101/375 |
| 6,725,774 | B2 | * | 4/2004 | Gottling et al. | 101/375 |

FOREIGN PATENT DOCUMENTS

| | | |
|---|---|---|
| DE | 476 667 | 5/1929 |
| DE | 655 466 C | 1/1938 |
| DE | 377854 | 7/1964 |
| DE | 2700118 C2 | 10/1987 |
| DE | 36 33 155 A | 4/1988 |
| DE | 296 01 150 U | 5/1996 |
| DE | 43 19 622 C2 | 7/1998 |
| FR | 1 275 904 A | 10/1961 |

* cited by examiner

*Primary Examiner*—Anthony H. Nguyen
(74) *Attorney, Agent, or Firm*—Lahive & Cockfield, LLP

(57) ABSTRACT

The invention relates to a holding device for a flexographic printing sleeve, which comprises at least one receiving member exhibiting a cylindrical side surface over which a printing sleeve can slide, said receiving member being able to rotate around its longitudinal axis and around the sleeve longitudinal axis. According to the invention, the receiving member comprises two or more shoulders with differing diameters and the holding device comprises a second identical receiving member. Both receiving members are placed in such a way that they can rotate around the same longitudinal axis and are oriented toward each other with their small shoulders. At least one of the receiving members can be moved along said longitudinal axis in such a way that the distance between said two receiving members can be adjusted.

4 Claims, 2 Drawing Sheets

HOLDING DEVICE FOR FLEXOGRAPHIC PRINTING SLEEVES

BACKGROUND OF THE INVENTION

The invention relates to a holding device for a flexographic printing sleeve.

A nongeneric holding device for a printing cylinder is already known from FR 1275904. This device has two conical receiving members for the printing cylinder provided with the printing image.

The fundamentally narrow contact surface between cone and cylinder providing the purely frictional transmission of force from the rotationally driven conical receiving members to the printing cylinder is disadvantageous in that comparatively heavy, thick-walled printing cylinders must be used which provide a sufficiently large contact surface for transmission of force through beveling at the two end faces of the cylinder. This large wall thickness also ensures that the compressive forces needed to hold the printing cylinder in place between the two receiving members do not deform the printing cylinder.

CH 377854 also discloses a likewise non-generic clamping device for the bearing support of rollers with paper, foil, and the like, in which device each end of the roller attaches to a conical receiving member in the form of a clamping cone. A form-fitting element acting as a rotational locking element is provided between the sleeve-shaped roller core and the clamping cone.

For this purpose, either a plurality of ribs and matching grooves must be formed on these two components, or the clamping cone must be molded in the material of the roller core such that this roller core is permanently deformed.

The device presented in CH 377854 is designed for holding only single-use rollers.

When the design disclosed in CH 377854 is transferred to printing equipment, the addition of grooves or ribs in sleeves of small wall thickness would not be possible. Permanent deformation of the printing sleeves by the receiving members would inhibit or preclude the multiple use of the printing sleeves, and would also carry the additional risk that the surface with the printing image would exhibit undesirable eccentricities.

In contrast to the teaching of FR 1275904, in one type of printing technology called "flexographic printing" instead of a complete one-piece printing cylinder, each with its own printing image, replaceable sleeves are used which may be slipped onto a cylindrical metal receiving member.

DE 2700118C2 or DE 3633155A1 disclose generic holding devices in which the cylindrical metal receiving member in each case extends through the entire length of the sleeve. The cylindrical receiving member is in other words a "permanent printing cylinder" since it may be used with multiple sleeves and thus for multiple printing images. Here each sleeve can display the printing image directly, for example etched or burned in by laser, or it can have a separate external plate layer with the printing image.

To mount the sleeves in flexographic equipment, compressed air exits the inner cylindrical receiving member and expands the partially mounted sleeve so that this may be slipped completely onto the receiving member. When the compressed air is switched off, the sleeve constricts and lies firmly in place on the cylindrical receiving member such that the sleeve may rotate together with the latter. The cylindrical receiving member is made of metal, and its resulting high cost of production and high weight impeding handling are thus disadvantageous.

In addition to utilization in the printing facilities themselves, i.e. in the printing presses, many of these devices are employed in the processing stations which are needed to create a printing sleeve and which also have a rotatable holder for the printing sleeves or their associated preliminary production stages, for example coating machines which coat the surface of the unfinished sleeve with light-sensitive or acid-sensitive materials by which the printing images are later applied to the sleeve surface by laser-based or etching processes. These etching or laser machines also require this type of rotatable holder for the printing sleeves.

Both during printing as well as during the preparatory production processes for the printing sleeves, a fundamental problem consists in the fact that printing sleeves of widely varying outside diameters are required. In one comparatively old technology, noticeably thin-walled metal printing sleeves were slipped onto cylindrical receiving members. The wall thickness of these sleeves had to be small to ensure the flexibility needed to allow the sleeves to be expanded by compressed air. As result, the cylindrical receiving members had almost the same diameters as the printing sleeves. Given a variety of outside sleeve diameters for the varying sizes of the printing images, a matching number of receiving members of varying diameters had to be kept on hand.

One simplification of the above for the user lies in the fact that sleeves of varying wall thickness may be used with receiving members of the same diameter so that a greater number of sleeves of varying outside diameters may be used where a reduced number of different receiving members are employed. Based in part on the use of plastics, these sleeves exhibit the flexibility needed to be expanded by compressed air despite these wall thicknesses.

Nevertheless, it is common to have a gradation in 10 mm steps of the outside diameters of the cylindrical receiving members. Given a size range of around 250 mm to 2000 mm for the sleeve circumferences matching the size of the printing images, even in the flexographic process a comparatively large number of receiving members need be kept on hand. This requires a very high total investment for the printing facilities, especially for the above-mentioned shops involved in the preparatory production: whereas a printing facility may specialize in processing printing images within a limited size range, laser-gravure and similar facilities are usually oriented around creating sleeves for the entire range of the above sleeve circumferences.

As a result, to reduce in practice the inventory of receiving members with differing outside diameters, sleeves are employed having sometimes very large wall thicknesses so that a sleeve of large outside diameter with a correspondingly large printing image may be used on a "small" receiving member.

The result is considerable expense and effort, especially when sleeves of such large wall thickness or diameter are used due to the considerable weight of such sleeves and especially of their associated cylindrical receiving members. Not all facilities have suitable in-plant handling equipment such as cranes, lifts, or the like which require a very high investment. For this reason, only sleeves of comparably small diameter can be processed. In addition, set-up times for changing receiving members are considerably shorter and thus more inexpensive if this change can be effected by hand, i.e. without such handling equipment.

SUMMARY OF THE INVENTION

The object of the invention is to improve a generic holding device such that the most inexpensive possible holding device simplifies the following: handling of the receiving member when the receiving member is changed, sleeve changeovers, and the changeovers of sleeves with different diameters.

This object of the invention is achieved by a holding device for a flexographic printing sleeve according to the teachings of the present invention.

The invention proposes, in other words, using two receiving members instead of one, which receiving members receive the sleeve between them, the receiving members each having two or more shoulders with varying diameters.

In contrast to a single cylindrical receiving member which extends the entire length of the printing sleeve, as is well known in flexography, the invention provides for considerable savings in weight, thereby simplifying handling when the receiving member or holding device is changed. Specifically, such changes are required less often since the receiving members allow various sleeves of differing inside diameters to be handled.

In contrast to the utilization of two conical receiving members familiar from other technical areas, axial compressive forces are avoided here so that even very thin-walled sleeves may be retained securely and without deformation. In addition, reliable support is provided in particular for extremely thin-walled sleeves by the cylindrical lateral surfaces: thin-walled sleeves which are often out of round at first are securely centered, after mounting on the receiving member, by the circular, constant-diameter circumference of the shoulder and take on a completely circular outer contour—thereby facilitating processability of an unfinished sleeve or ensuring a precise and uniform print image in the case of a finished printing sleeve.

In this way, sleeves of highly varying outside diameters may be held in place on the same receiving member while the wall thickness of the sleeves can remain comparatively small since the sleeve may be slipped onto the section of the receiving member which most nearly approximates the desired outside diameter of the sleeve. Three advantages result from this:

1. Handling of the receiving members during its exchange is simplified because two rather than one receiving member are provided, each individual receiving member thus being of lighter weight, and because the two receiving members together do not extend over the entire length of the sleeve; instead each receiving member is located only in the region of one end of the sleeve.
2. Exchange of the sleeves is simplified because the use of shoulders in the receiving members allows the wall thickness of the sleeve to optimally approximate the desired outside diameter—with the result that thin-walled, and thus correspondingly light-weight sleeves may be provided which are therefore easy to handle.
3. Exchange of the sleeves with differing diameters is in many cases simplified because the receiving members often do not have to be replaced. Instead, in many cases simply another shoulder of the receiving member may be used for the new sleeve which has a inside diameter different from that of the previously used sleeve.

To change the sleeves, both receiving members may be "opened" in the familiar fashion, i.e. moved apart, while to secure the sleeves the two receiving members are then moved back together. A system may be provided here whereby the two receiving members are arranged on a common, physically realized axis on which at least one of the receiving members is mounted so as to be longitudinally movable. In an alternative system, the two receiving members are arranged on a virtual common rotational or longitudinal axis, for example by having both receiving members rotationally mounted and freely protruding, each at one base.

The two-piece design of the previously one-piece, cylindrical, metal receiving member, as well as the gradation into smaller diameters and a design length which may be shorter than half of a previous, traditionally used receiving member, all combine to result in a considerable reduction in the weight of the individual manipulated components such that as a rule the use of a crane is not required.

As a result of the reduced weight, the bearings of the receiving member in the holding device may be designed to be smaller and cheaper. Fewer receiving members must be kept on hand since sleeves of different inside diameters may be used on the same receiving member. An additional factor is the elimination of handling equipment such as cranes or the like.

A fourth advantage is the fact that production costs for the holding device are lower, and specifically that overall investment costs for the user are considerably reduced as compared with those incurred by the use of traditional holding devices.

Set-up times are considerably reduced since sleeves of different diameters may be used on the same receiving member and replacement of the receiving member is seldom required. It is not only the mounting time which must be considered here but also the subsequent inspection to verify the concentricity and cylindricity of the receiving member. Operating costs are also lower than when traditional receiving members are used.

Since the receiving members do not support the sleeve along its entire length, the risk of the sleeve sliding out of position when the receiving member is driven can be avoided by providing teeth between the receiving member and the sleeve, the teeth being in either an axial and/or radial orientation. To preclude the risk of deforming thin-walled sleeves, or if the wall thickness of the sleeve does not allow for the teeth, an alternative approach is to roughen the lateral surface of the shoulders to increase friction or to coat them - thereby enhancing the frictional connection to the sleeves.

According to the invention, the receiving members take up a maximum of half the length of the receiving tube if both receiving members are inexpensively designed to be the same. To ensure a secure grip of the sleeve, the section of the receiving member extending into the sleeve must not be shorter than a certain minimum length which depends, for example, on the materials used and on the possible teeth or frictional properties given to the surface. As a result, the number of shoulders for each receiving member is limited.

In order to utilize the greatest possible range between 250 mm and 2,000 mm of the sleeve circumference, multiple types of receiving members may be provided for which the shoulder diameters vary from type to type.

In order to make replacement of the receiving members even more infrequent and to keep these receiving members available as often as possible, an additional component may be provided in the holding device which renders the sleeve quasi-two-layered, i.e., an inner "support sleeve" onto which the actual sleeve to be processed or having the print surface can be slipped in the familiar fashion for flexographic equipment. The support sleeve, in other words, represents the intermediate stages which the receiving member does not have due to the above limitations.

The support sleeve may advantageously be rigid, lightweight, and nonflexible, consisting, for example, of a material such as foam aluminum or the like, of fiber composites, or of a sandwich construction, while the actual sleeve may consist of a more flexible (and possibly heavier) material which facilitates mounting typical in flexography. This mounting may be either on the support sleeve, for example initially for processing the unfinished sleeve or also on printing presses that have the staged receiving members as well as a support sleeve. Mounting may, however, also be on printing presses which have traditional one-piece receiving members.

To enable the sleeve to be mounted, the support sleeve has air channels allowing compressed air to be conveyed from an air compressor through the support sleeve and the outer sleeve to be slipped on in the fashion typical of flexography. The "complete sleeve" consisting of the actual sleeve and the support sleeve may now be easily handled and held between the receiving members.

The support sleeve, in other words, replaces the comparatively much heavier and more expensive flexographic cylinder. Even when the sleeves are not immediately mounted on the receiving members and only additional support sleeves are utilized, there are considerable advantages in terms of handling.

Due to the fact that multiple support sleeves of different outside diameters may be designed, a precise gradation of the overall system is possible in which the receiving members are designed with few shoulders, and fine adjustment to match nearly any outside diameter of the printing sleeves is effected by the use of the appropriate support sleeves. In addition, the support sleeve reinforces the sleeves of small wall thickness, thereby creating a stronger complete sleeve and facilitating the handling of the sleeves without damage. Specifically, this factor enables attachment to the receiving members in a way in which nonreinforced sleeves could be damaged; for example when teeth are provided and a very thin-walled sleeve is to be used, or when the sleeve does not expand in the typical flexographic fashion to be released from the receiving member but is instead mechanically clamped to the receiving member.

The use of support sleeves considerably simplifies and speeds up the handling of the sleeves: Instead of lifting the traditional printing cylinder with a crane into a special mounting device from which it is slipped onto the sleeve, the support sleeve may be placed vertically on the floor and attached by a quick-release device to the compressed-air supply so that the sleeve may subsequently be "slipped over." Also, instead of inserting the traditional printing cylinder with the sleeve into the processing or printing press and setting concentricity and cylindricity, the "complete sleeves" consisting of sleeve and support sleeve may be mechanically clamped between the receiving members without the need for further alignment. Specifically, the time for sleeve replacement may be reduced to ⅕ or 1/10 of the time traditionally required.

To facilitate handling and enable the lowest weight possible for sleeves and support sleeves, the latter may have the smallest wall thicknesses possible. To preclude deformation and damage both during processing and also later during the printing operation, the sleeves or support sleeves may have reinforcing elements in their inner cavity, for example, a core made of fiber composite materials or of a light-weight material such as foam aluminum, or extruded sections, for example made of aluminum having a cross-section which is, for example, stellate or cruciform or of similar design, or for example in the shape of a polygonal tube.

DESCRIPTION OF ILLUSTRATED EMBODIMENT

Figure 1:
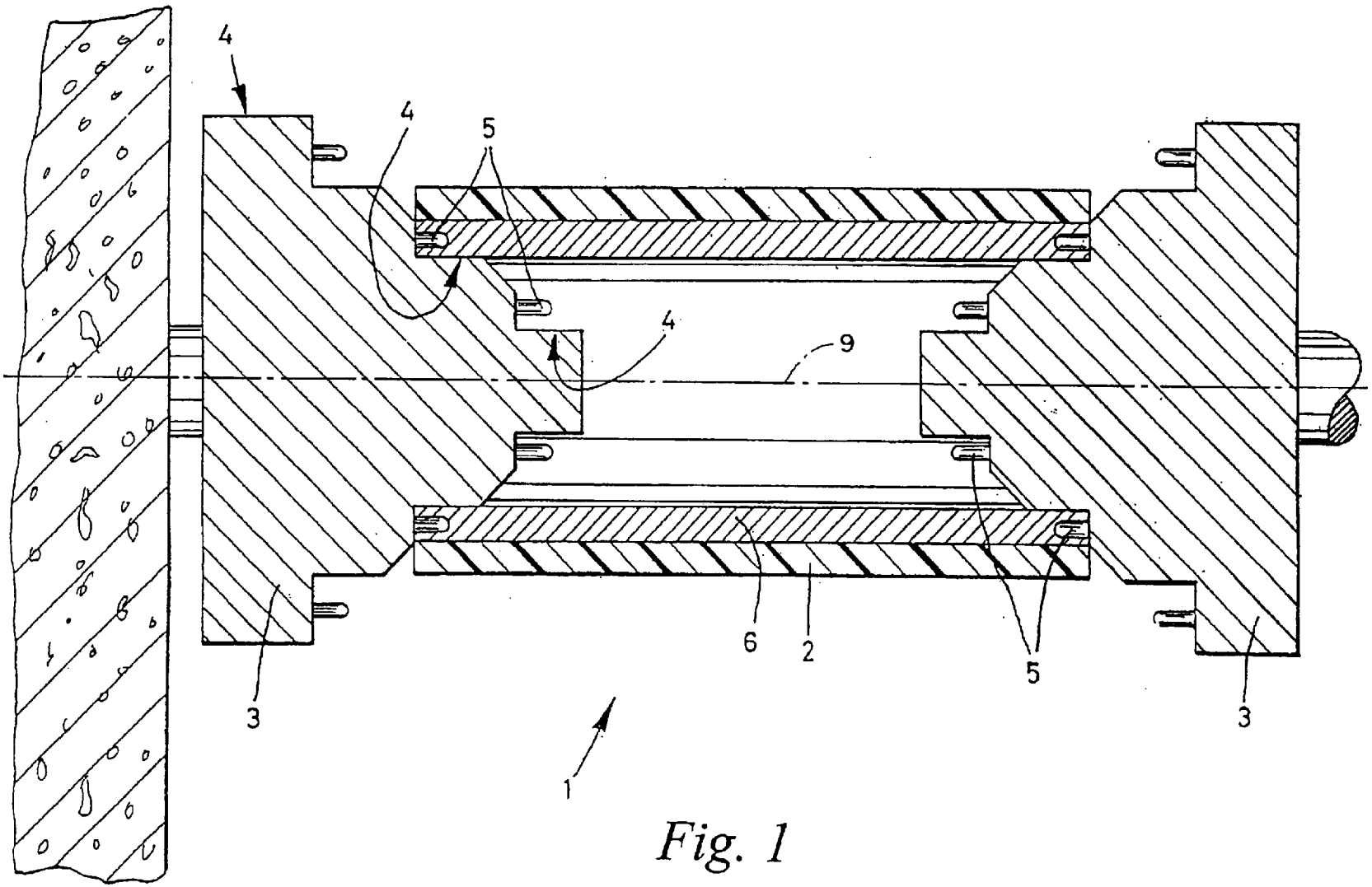
FIG. 1 is a schematic view of the holding device of the present invention.
Figure 2:
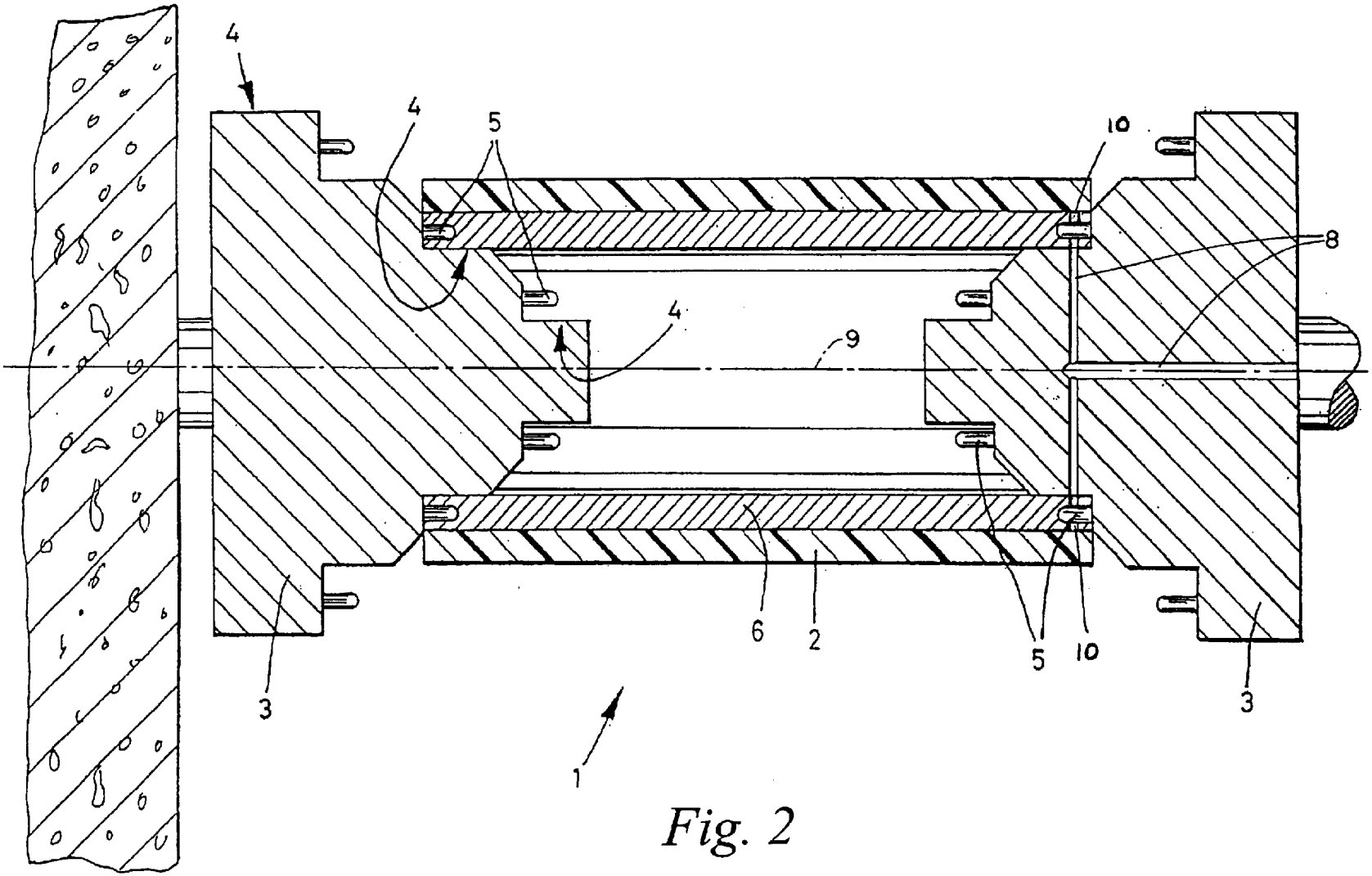
FIG. 2 is a schematic view of a holding device of the present invention having air channels.

A purely schematic cross section through a holding device 1 is shown which serves to hold sleeves 2, sleeves 2 acting as "printing sleeves," this term referring to the use of sleeves 2 in the printing industry. Sleeve 2 may be ready for use, or it can also be an "unfinished" sleeve which passes through certain production stages to create a ready-to-use printing sleeve.

Each end face of sleeve 2 is slipped onto one receiving member 3 which in turn has multiple shoulders 4 of different diameters with cylindrical lateral surfaces. Shown simply as an example, some shoulders are provided with four chamfers which facilitate the slipping on of the sleeves onto the receiving members 3; however the receiving members 3 may also be designed without such chamfers or with chamfers on all shoulders 4.

Both receiving members 3 are rotatable. Here the receiving member 3 shown at the left is held in the base indicated which represents a nondriven support. At the receiving member 3 shown at the right is a shaft end which leads to a machine base which contains a drive unit for this right-hand receiving member 3 such that the sleeve 2 may be caused to rotate. Deviating from this embodiment, both receiving members 3 may be rotationally driven synchronously. The right-hand receiving member 3 may be axially 9 displaced along with the shaft whose shaft end is indicated within a plain bearing of the machine base not shown, or possibly displaced together with the machine base, so as to position the sleeves 2 between the receiving members 3, or to remove them from the receiving members 3, as well as to adjust the distance between the receiving members 3 to the differing lengths of sleeves 2. The axial 9 displacement of the receiving member 3 may be effected, for example, pneumatically since the mounting of sleeves is typically effected in flexography by compressed air.

A rotationally locked retention of sleeve 2 on the receiving member 3 is ensured by toothed elements 5 which extend into a support sleeve 6 carrying the sleeve 2. The toothed elements 5 are shown in this embodiment purely schematically, and as an example, as axially-parallel-running pins which are provided on the receiving members 3. The complete sleeve composed of the actual sleeve 2 and the support sleeve 6 has in the support sleeve 6 matching toothed elements to receive the pins. Deviating from this purely schematic representation, the wall thicknesses of sleeve and support sleeve may be quite different. A thin-walled sleeve may, for example, be mounted on a thick-walled support sleeve—with the greater wall thickness of the support sleeve permitting as needed the design of the toothed elements which possibly could not be realized within the sleeve due to its small wall thickness.

The support sleeve 6 has air channels 10 through which compressed air is conducted to the lateral surface of the support sleeve 6 so that the sleeve 2 may be attached in the familiar fashion to the support sleeve 6 to form the complete sleeve. Irrespective of the material used for the support sleeve 6, provision can be made to create the air channels out of pressure-resistant hoses or tubes, for example made of metal or plastic which may be arranged in the wall of the thick-walled support sleeves 6, for example having been molded in, foamed in or laminated in, and which may be fixed along the interior side of thin-walled support sleeves 6, for example screwed in and/or glued. Passage bores may be provided to conduct the air from the air channels to the lateral surface of the support sleeve 6.

Mounting of the sleeve 2 onto the support sleeve 6 occurs in a set-up station before the complete sleeve formed from sleeve 2 and support sleeve 6 is secured in the device 1. Since the support sleeve 6 may consist of a lightweight composite, a foam metal, or the like, the lightweight design is achieved, and thus the simple, crane-less handling of the above-mentioned complete sleeve as well.

The device 1 shown may be provided in the area of a processing station in which a printing sleeve is produced from sleeve 2, in this case sleeve 2 being an unfinished sleeve. If needed, however, the printing unit itself may be equipped with such a device 1 in place of the traditional printing cylinders to receive sleeve 2, in this case sleeve 2 being a printing sleeve.

The support sleeve 6 serves as a kind of adapter to receive the actual sleeve 2 which has the printing image. Such adapters may be eliminated if the receiving members 3 have shoulders 4 with suitable diameters for the desired sleeves 2 and if the sleeve can be properly secured on the receiving member 3, for example by suitable teeth (form-fitting connection) or by the rigidity which a fixed rotationally locked clamping (frictional connection) of the sleeve 2 between the receiving members 3 allows. This rigidity may be achieved with plastic sleeves, for example by fiber reinforcements. The frictional connection may additionally be improved by the friction-enhanced design of the interacting surfaces of the sleeve and receiving member.

Thus, depending on the usual specification profile for the individual users, different receiving members with differing shoulder diameters may be provided. In addition, an alternative to using the support sleeve 6 is that the user, in order to use the sleeves 2 with differing inside diameters, employs instead the comparatively small and light, easy-to-handle receiving members 3 of the device 1 so that the receiving members 3 may be used which have a shoulder 4 with the outside diameter appropriate for the inside diameter of the sleeve 2 or the support sleeve 6 which are to be employed.

If no support sleeves are to be used, air channels 8 may be provided in the receiving members 3 in a manner similar to that for the familiar, comparatively large cylinders known in the field of flexography: Here the outlet openings for the air are provided in the lateral surfaces of the shoulders to expand the sleeves 2 and enable them to be slipped directly onto the receiving members 3. Outlet openings on shoulders not used may be blocked or closed by means of suitable valves or plugs.

What is claimed is:

1. Holding device for a flexographic printing sleeve, the holding device having at least one receiving member with a cylindrical lateral surface for mounting the printing sleeve, the receiving member being rotatable about a longitudinal axis of the printing sleeve, characterized in that the receiving member has two or more shoulders of differing diameters and that a second, equivalent receiving member is provided, both receiving members being arranged and rotatable about the longitudinal axis, and the receiving members with their smallest shoulders being aligned with each other, and at least one receiving member being adjustable along the longitudinal axis to set a variable distance between both receiving members, and an inner support sleeve to receive the sleeve, the support sleeve having air channels leading from an end face or from an inner surface of the support sleeve to an outer surface of the support sleeve.

2. Device according to claim 1, characterized in that the receiving member has toothed elements in radial or axial orientation which interface with corresponding toothed elements allocated to the sleeves.

3. Device according to claim 1, characterized in that the sleeve has reinforcing elements in an cavity.

4. Device according to claim 1, characterized in that the support sleeve has reinforcing elements in an inner cavity.

* * * * *